United States Patent [19]

Taguchi et al.

[11] Patent Number: 4,908,863

[45] Date of Patent: Mar. 13, 1990

[54] MULTI-PULSE CODING SYSTEM

[76] Inventors: Tetsu Taguchi; Shigeji Ikeda, both of Tokyo, Japan

[73] Assignee: NEC Corporation, Tokyo, Japan

[21] Appl. No.: 79,327

[22] Filed: Jul. 30, 1987

[30] Foreign Application Priority Data

Jul. 30, 1986 [JP] Japan ..... 61-180363

[51] Int. Cl.[4] ..... G10L 3/02

[52] U.S. Cl. ..... 381/36; 381/40

[58] Field of Search ..... 381/41–53, 381/36–40

[56] References Cited

U.S. PATENT DOCUMENTS 4,076,958 2/1978 Fulghum ..... 381/51
4,282,405 8/1981 Taguchi ..... 381/49
4,301,329 11/1981 Taguchi ..... 381/37
4,669,120 5/1987 Ono ..... 381/40
4,720,861 1/1988 Bertrand ..... 381/36

*Primary Examiner*—Gary V. Harkcom
*Assistant Examiner*—David D. Knepper
*Attorney, Agent, or Firm*—Sughrue, Mion, Zinn, Macpeak & Seas

[57] ABSTRACT

A digital speech signal sampled at a predetermined interval is stored in a memory. An LPC (Linear Prediction Coefficient) is developed from the speech signal and thus developed LPC coefficient specifies coefficients of a recursive filter. The speech signal read out from the memory is backwardly supplied to the recursive filter in the reverse order to the sampling order of the speech signal. A plurality of multi-pulses are determined on the basis of the crosscorrelation coefficients (between the speech and an impulse response of the recursive filter) obtained by the recursive filter.

9 Claims, 2 Drawing Sheets

MULTI-PULSE CODING SYSTEM

BACKGROUND OF THE INVENTION

The present invention relates to a multi-pulse coding system, and more particularly, to a multi-pulse coding system capable of realizing high-quality speech processing at low bit rates with a small amount of arithmetic operations.

The multi-pulse coding system, in which exciting source information of speech to be analyzed (input speech) is expressed by a plurality of pulses, i.e., by multi-pulses, has been known and used because of its capability of realizing high-quality coding. The fundamental concept of this system is described, for instance, on Pages 614 to 617 of "A New Model of LPC Excitation for Producing Natural-Sounding Speech at Low Bit Rates", Bishnu S. Atal and Joel R. Remde, Proc. ICASSP 1982. A method for searching the multi-pulse with high efficiency has been proposed by Araseki et al, in a paper entitled "Multi-Pulse Excited Speech Coder Based On Maximum Crosscorrelation Search Algorithm", Proc. Global Telecommunication 1983, on pages 794 to 798.

In the multi-pulse search, an acoustic weighting filter is utilized for improving an acoustic S/N ratio of the synthesized speech than the actual (physical) S/N ratio. This technique is called "noise shaping". A well-known arrangement for the noise shaping is such that the acoustic weighting filter having a transfer function given by the formula (1) is provided on the input side of a multi-pulse searcher (or coder) at the transmitting side (analysis side), and a filter having the reversed transfer function to that of the filter at the analysis side are provided on the output side of a multi-pulse decoder at the receiving-side (synthesis side).

$$W(Z) = \left(1 + \sum_{i=1}^{P} \alpha_i \cdot Z^{-i}\right) \Big/ \left(1 + \sum_{i=1}^{P} \gamma^i \alpha_i Z^{-i}\right) \quad (1)$$

where $\alpha_i$ is $\alpha$ parameter defined as an LPC coefficient, P; the degree of the LPC coefficient to be developed and $\gamma$; the weighting coefficient whose value ranges $0<\gamma<1$.

In FIG. 1, #2 represents a spectrum exhibiting a frequency characteristic, expressed by the formula (1), of the acoustic weighting filter disposed at the transmitting side, and #5 denotes a spectrum exhibiting the frequency characteristic (reversed characteristic of #2) of the filter at the receiving side. An input speech indicated by a spectral characteristic #1 is subjected to the acoustic-weighting processing through the above-mentioned filter at the transmitting side to develop a signal represented by a spectal characteristic #3. The multi-pulse is obtained by a known technique on the basis of thus acoustic-weighted signal, coded and then transmitted via a transmission channel to the receiving side. The coded signal includes white quantizing noises indicated by #4. The received signal is decoded on the receiving side and thereafter subjected to an inverse acoustic-weighting processing through the receiving filter. This decoding process includes the restoration of the multi-pulse and the reproduction of the speech replica through the synthesis filter. The decoded signal, containing the white noises represented by a spectral characteristic #4, is subjected to the inverse acoustic-weighting processing, whereby the speech signal having the spectral characteristic #1 is restored. In this way, the quantizing noises are related with the spectral characteristic of the input speech. As is obvious from FIG. 1, the electric power level of speech consequently exceeds that of noises at all frequency range, thus realizing noise-masking. As a result, the S/N ratio is virtually improved, and so-called "noise shaping effect" is achievable. The numerator of the right side in the formula (1) indicates an inverse characteristic of the frequency transfer characteristic expressed by $$1/\left(1 + \sum_{i=1}^{P} \alpha_i Z^{-i}\right)$$

which corresponds to the spectral envelope of the input speech signal, and functions levelling the spectral envelope of the input speech. The denominator of the right side member in the formula (1) indicates the frequency transfer characteristic having frequency poles coincident with the central frequencies of a plurality of frequency poles obtained by analyzing the input speech signal. $\gamma$ is the coefficient to be multiplied by the LPC coefficient to reduce the arithmetic operation time required for the multi-pulse development. The bandwidth of the frequency pole, as is well-known, depends upon $\gamma$. For instance, when $\gamma=1.0$, the bandwidth coincides with that of the frequency pole in the spectral envelope of the input speech signal. Where $\gamma<1.0$, the bandwidth is broader than that of the frequency pole in the spectral envelope of the input speech signal. The bandwidth monotonously increases in proportion as $\gamma$ approximates to 0. The frequency transfer characteristic of the speech signal which has passed through the filter (filter characteristic w(z)) may be therefore expressed by $$1/\left(1 + \sum_{i=1}^{P} \gamma^i \alpha_i Z^{-i}\right).$$

This indicates that there performs enlarging and levelling the bandwidth there performs enlarging and levelling the bandwidth of the frequency pole of the spectral characteristic $$1/\left(1 + \sum_{i=1}^{P} \alpha_i Z^{-i}\right)$$

which is acquired by analyzing the input speech signal. A duration time of the impulse response is shorter than that of the filter controlled by the LPC coefficient developed by analyzing the input speech signal, which is established by experience. For example, in many cases the virtual duration time of impulse response of the synthesis filter based on the LPC coefficient $\alpha_i$ exceeds 100 msec. On the other hand, the duration time of impulse response of the synthesis filter based on $\gamma_i \cdot \alpha_i$ is hardly exceed 5 msec when $\alpha=0.8$.

As described above, the duration time of impulse response of the synthesis filter decreases by using the acoustic-weighting process with the attenuation coefficient $\gamma$. Shortening the impulse response duration time, however, requires more number of multi-pulses to acquire the good synthesized speech quality. This is the great hindering factor from realizing low bit rate coding. On the other hand, when searching the multi-pulse without performing the acoustic-weighting process, the impulse response length (duration) increases. This duration time increase makes it possible to approximate the input speech waveform with a small number of multi-pulses. On the contrary, however, a considerable increment in amount of the arithmetic operations is caused. In the technique, proposed by Araseki et al, for determining the multi-pulse on the basis of a crosscorrelation coefficient between the input speech waveform and the impulse response waveform of the synthesis filter, it is necessary to sequentially obtain a sum of products of the two sampled data of such waveforms. Therefore, the number of operations to obtain the sum of products increases as the impulse response time increases.

SUMMARY OF THE INVENTION

An object of the present invention is to provide a multi-pulse coding system in which an amount of arithmetic operations for searching the multi-pulses is considerably reduced.

Another object of the present invention is to provide a multi-pulse coding system capable of operating at low bit rates.

Other object of the present invention is to provide a multi-pulse coding system capable of realizing high-quality speech processing at low bit rates.

According to the present invention, a digital speech signal sampled at a predetermined interval is stored in a memory. An LPC coefficient is developed from the speech signal and thus developed LPC coefficient specifies coefficient of a recursive filter. The speech signal read out from the memory is backwardly supplied to the filter in the reverse order to the sampling order of the speech signal. A plurality of multi-pulses are determined on the basis of the crosscorrelation coefficient between the speech signal and the impulse response of the filter obtained from the filter.

Other objects and features of the invention will be clarified from the following description with reference to the drawings.

DETAILED DESCRIPTION OF THE PREFERRED EMBODIMENTS

Figure 2:
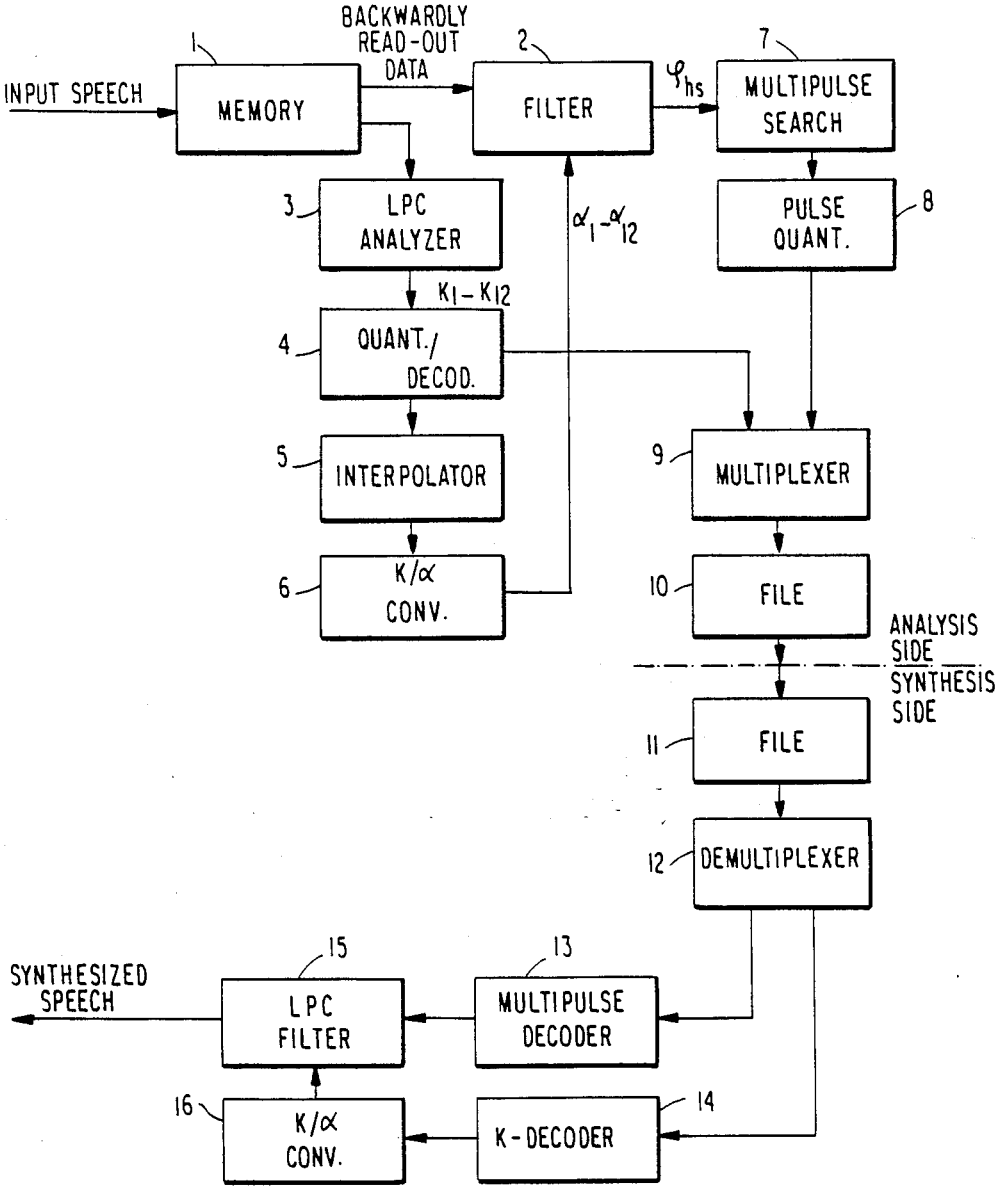
FIG. 2 is a block diagram of a speech analysis and synthesis apparatus with multi-pulses according to one embodiment of the present invention.

An embodiment shown in FIG. 2 is a speech analysis and synthesis apparatus based on a multi-pulse searching technique in which a crosscorrelation coefficient proposed by Araseki et al. is employed. Input speech signal to be analyzed is supplied backwardly (in the time direction from the new to the old) to a recursive filter. Each of the sums of products between the sampled values of the impulse response waveform and the input speech waveform is obtained by the recursive filter and then the multi-pulses are searched.

An analysis side comprises a waveform memory 1, a filter (LPC filter) 2, an LPC analyzer 3, quantizing/decoding device 4, an interpolator 5, a K/$\alpha$ converter 6, a multi-pulse searcher 7, a pulse quantizer 8, a multiplexer 9 and a file 10; and a synthesis side comprises a file 11, a demultiplexer 12, a pulse decoder 13, a K decoder 14, an LPC synthesis filter 15 and a K/$\alpha$ converter 16.

The waveform memory 1 stores sampled and quantized input speech waveform (digital speech signal). From the memory 1 the quantized signals are forwardly (in the sampling sequence order of the input speech) and backwardly (in the reverse order to that of the sampling sequence) read out. The forwardly read out signal and backwardly read out signal are supplied to the LPC analyzer 3 and the filter 2, respectively.

The LPC analyzer 3 develops linear predictive coefficients, for example, K parameters $K_1$ to $K_{12}$ of 12th degree on the basis of the signal forwardly read out from the memory 1 for every analysis frame, and thus developed K parameter is supplied to the quantizing/decoding device 4.

The quantizing/decoding device 4 temporarily quantizes and decodes the K parameter, thereby roughly equalizing a quantizing error-condition to that in the exciting signal of the filter 2. Thereafter, the decoded output is supplied to the interpolator 5 to interpolate the K parameter at a predetermined interpolating interval and the interpolated signal is then supplied to the K/$\alpha$ converter 6.

The K/$\alpha$ converter 6 converts the thus interpolated K parameter into an $\alpha$ parameter, and supplies the $\alpha$ parameter $\alpha_i$(i=1, 2, . . . , 12) to the recursive filter 2 as a filter coefficient. The filter 2 is defined as an all-pole type digital filter which functions as an LPC speech synthesis filter.

The filter 2 develops crosscorrelation coefficients between the input speech backwardly read out from the memory 1 and the impulse response by determining the sum of products between them for every analysis frame. The sum of products is readily obtained by the filter arithmetic operation, which is of importance for this invention. The detailed description on this point will be made later.

The present invention realizes the multi-pulse coding at low bit rates without acoustic-weighting process. Therefore, the "noise shaping" effects are not present. The "noise shaping" effects are, as explained before, exhibited only under a good condition of the S/N ratio, in other words under a condition that a sufficient number of multi-pulses can be set. The S/N ratio is, however, smaller under such low bit rates coding condition in the present invention, and hence the speech quality undergoes little influence even if the acoustic-weighting process is not executed. A remarkable decrease in amount of arithmetic operations is deemed still much more advantageous. Furthermore, the impulse response is obtained without a process of multiplying the LPC coefficient by the attenuation coefficient, so that the crosscorrelation coefficient $\phi_{hs}$ can be determined with extremely high accuracy.

The crosscorrelation coefficient $\phi_{hs}$ obtained by the filter 2 is supplied to the multi-pulse searcher 7 where the maximum crosscorrelation coefficient is searched and the multi-pulse is determined on the basis of thus searched result by the well-known technique. The multi-pulse is determined as follows.

A difference between the synthesized signal by using K multi-pulses and the input speech is given by the following formula (2).

$$\epsilon = \sum_{n=1}^{N} \left( S_n - \sum_{i=1}^{K} g_i \cdot h_{n-mi} \right)^2 \quad (2)$$

where N is the analysis frame length (expressed by number of sample points within one analysis frame), and $g_i$, $m_i$ respectively denote the i-th pulse amplitude and the i-th pulse location (time position) in the analysis frame. The amplitude and location of such a pulse having the minimum $\epsilon$ are determined by partially differentiating the formula (2) with respect to $g_i$ and by setting the differentiated formula at zero.

$$g_i(m_i) = \max \frac{\left| \phi_{hs}(m_i) - \sum_{l=1}^{K-1} g_l \cdot R_{hh}(|m_l - m_i|) \right|}{R_{hh}(0)} \quad (3)$$

$$1 \leqq m_i \leqq N$$

where $R_{hh}(0)$ is the autocorrelation coefficient of the impulse response of the speech synthesis filter, and $\phi_{hs}$ is the crosscorrelation coefficient between the input speech waveform and the impulse response waveform. The formula (3) indicates that the amplitude $g_i(m_i)$ is optimum under setting the pulse at the location $m_i$. In order to determine the $g_i(m_i)$, the crosscorrelation coefficient is corrected by subtracting the second term of the numerator in the formula (3) from the crosscorrelation coefficient $\phi_{hs}(m_i)$ for each multi-pulse determination. Thereafter, the corrected crosscorrelation coefficient is normalized with the autocorrelation coefficient $R_{hh}(0)$ at the zero time delay. The maximum absolute values of the normalized coefficient is searched to determine the multi-pulse. The number of multi-pulses to be searched is set at quite small number as compared with that in the conventional coding system. This is, as described above, due to the capabilities of extremely high-accuracy determination of the crosscorrelation coefficient and of expressing the input speech waveform by a small number of multi-pulses, in view of application condition in the analysis and synthesis system. The application conditions involves the use of a variety of public messages which are not highly required for the fidelity of the synthesized speech. Under such circumstances, the neglection of the correction of the crosscorrelation coefficient does not cause serious inconvenience for the application. This is the reason why no correction is made in the embodiment of FIG. 2.

The pulse quantizer 8 quantizes the thus searched multi-pulse per analysis frame and supplies the multiplexer 9 with the resultant multi-pulse.

The multiplexer 9 codes the multi-pulse and the K parameter and properly combines both coded signals into a multiplexed signal in a predetermined form. The multiplexed signal is stored in the file 10. Then, the multiplexed signal is transmitted via the transmission path to the synthesis-side.

At the synthesis-side the content of the file 10 is received through the transmission path and is stored in the file 11. Then this received signal has been demultiplexed by the demultiplexer 21. The coded multi-pulse and K parameter data are respectively supplied to the decoder 13 and the K decoder 14. The decoded multi-pulse and $\alpha$ parameter converted by the K/$\alpha$ converter 16 are supplied to the LPC synthesis filter 15 as an input and as a filter coefficient, respectively.

The LPC synshteis filter 15 is an all-pole type digital filter. In response to the filter coefficient and the exciting source inputs, the filter 15 generates the synthesized speech signal. An analog synthesized speech is obtained through the D/A conversion and a low-frequency filtering process.

The present invention determines the crosscorrelation coefficient $\phi_{hs}$ between the input speech and the impulse response of the LPC filter, as described above, by backwardly supplying the input speech waveform to the filter, thereby considerably reducing the arithmetic operation amount. The details on this point will be described with reference to FIG. 3.

Figure 1:
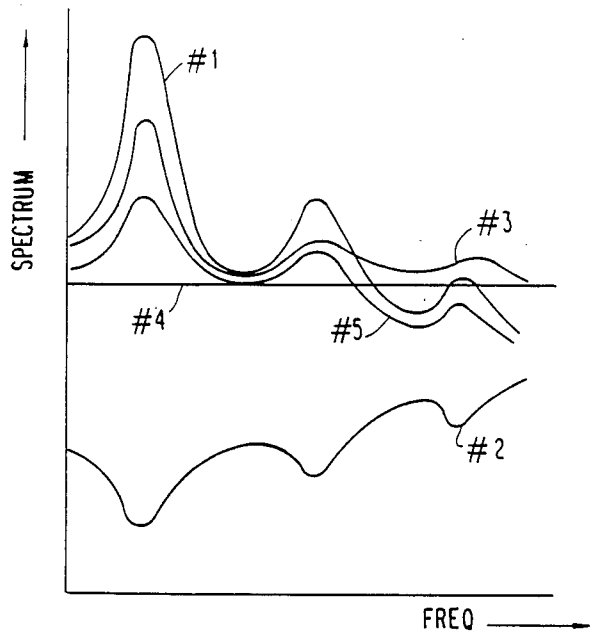
FIG. 1 is a diagram showing a principle of improving an S/N ratio by acoustic-weighting.
Figure 3:
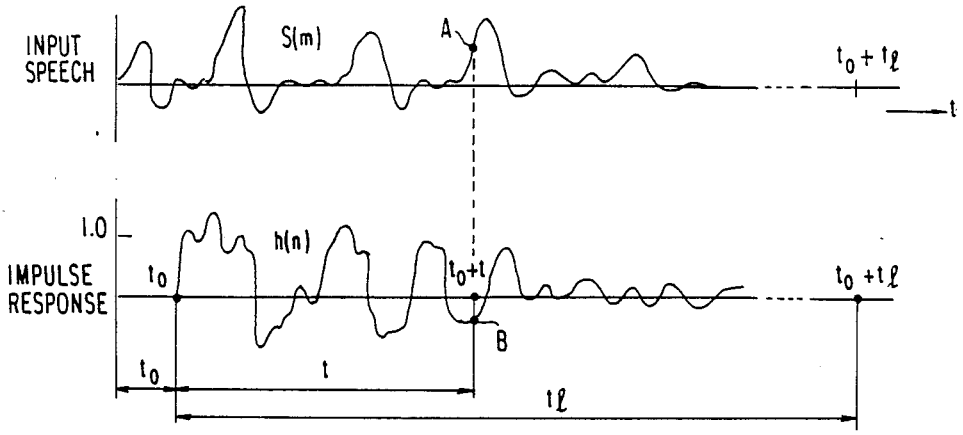
FIG. 3 is a diagram showing a principle of determining a crosscorrelation coefficient employed for searching the multi-pulses according to the present invention.

The crosscorrelation coefficient $\phi_{hs}$ is obtainable, for instance, by summing (integrating) the product of a sample A on the input speech waveform and a corresponding sample B of the impulse response waveform of the filter in FIG. 3 from a time point $t_0$ to $t_0+t_l$. In FIG. 3, t denotes the sample time, $t_0$ is the time delay of the impulse response, $t_l$ is the impulse response duration length and $t_0+t_l$ is the sample time that the level of the impulse response can be virtually ignore.

Let the sample value of the input speech waveform be S(m) ($m=0, 1, \ldots, t_0-1, t_0, t_0+1, \ldots, t_0+t-1, t_0+t, \ldots, t_0+t_l$), and the impulse response; h(n) ($n=0, 1, 2, \ldots, t-1, t, t+1, \ldots, t_l$), the crosscorrelation coefficient $\phi_{hs}(0)$ is given by:

$$\phi_{hs}(t_0) = \sum_{t=t_0}^{t_0+t_l} S(t_0+t) \cdot h(t) \quad (4)$$

Since the arithmetic operation of the formula (4) has been conventionally performed by using a multiplier, the arithmetic operation amount required for obtaining one $\phi_{hs}$ depends upon the duration $t_l$ of the impulse response.

The present invention, on the other hand, determines the sample product of A and B through the filter (conventional recursive filter) operation by supplying the sample A backwardly read out. This is understandable from the following explanation. The sample B may be obtained as the filter output after the time t when inputting the amplitude 1 to the filter instead of the sample A. The filter output, therefore, becomes (A·B) after the time t when inputting the sample A, i.e., $S(t_0+t)\cdot h(t)$ is determined. Similarly, when a sample $S(t_0+t-1)$ is inputted to the filter 2, the filter output after the time $(t-1)$ becomes $S(t_0+t-1)\cdot h(t-1)$. This relation is established at any time point of $t_0 \leqq t \leqq t_0+t_l$.

It is assumed here that the speech waveform samples are backwardly supplied to the filter, that is, in the reverse order to the sampling sequence order of the input speech. The supplied samples are $S(t_0+t-1)$, $S(t_0+t)$, $S(t_0+t-1)$, .... The output level of the filter is $S(t_0+t_l)\cdot h(t_l)$ after the time $t_l$ when the sample $S(t_0+t_l)$ at the time $(t_0+t_l)$ is supplied to the filter for the above-mentioned reason. The output level of the filter after the time t when the sample $S(t_0+t)$ (=A) at the time $(t_0+t)$ is supplied to the filter likewise comes to $S(t_0+t)\cdot h(t)$. As a matter of course, the output level of the filter is $S(t_0)\cdot h(0)$ just when the sample $S(t_0)$ at the time $t_0$ is supplied to the filter.

The filter 2 is a linear filter, so that a concept of superposition is established. Provided that the duration of the impulse response of the filter is shorter than $t_l$, the output $u(t_0)$ of the filter at the time $t_0$ is expressed by the formula (5)

$$\begin{aligned} u(0) &= S(t_0+t_l)\cdot h(t_l) + S(t_0+t_l-1)\cdot h(t_l-1) + \\ &\quad \ldots + S(t_0+t)\cdot h(t) + \ldots + S(t_0)\cdot h(0) \\ &= \sum_{t=0}^{t_l} S(t_0+t)\cdot h(t) \\ &= \phi_{hs}(t_0) \end{aligned} \tag{5}$$

The output $u(t_0-1)$ of the filter is given by the formula (6) when the sample $S(t_0-1)$ at the time $(t_0-1)$ is supplied to the filter.

$$\begin{aligned} u(t_0-1) &= S(t_0+t_l)\cdot h(t_l+1) + S(t_0+t_l-1)\cdot h(t_l) + \\ &\quad \ldots + S(t_0+t)\cdot h(t+1) + \ldots + \\ &\quad S(t_0)\cdot h(1) + S(t_0-1)\cdot h(0) \\ &= \sum_{t=0}^{t_l} S(t_0-1+t)\cdot h(t) \\ &= \phi_{hx}(t_0-1) \end{aligned} \tag{6}$$

where $h(t_l+1)=0$. In other words, the crosscorrelation coefficients may be consecutively obtained by backwardly supplying the samples to the filter. This is a strong point and an important feature of the present invention.

On the other hand, it is impossible to obtain the crosscorrelation coefficient in the similar manner by the conventional forward supply of the speech samples on the following grounds. When the speech sample S(0) is supplied, the output u'(0) of the filter is given:

$$u'(0)=S(0)\cdot h(0)=S(0)$$

since h(0) 1 For the input of the sample S(1), the output u'(1) of the filter is obtained:

$$u'(1)=S(1)\cdot h(0)+S(0)\cdot h(1)$$

When the sample S(i) is supplied, the output u'(i) of the filter is given as follows:

$$\begin{aligned} u'(i) &= S(i)\cdot h(0) + S(i-1)\cdot h(1) + \ldots + S(0)\cdot h(i) \\ &= \sum_{j=0}^{i} h(j)\cdot S(i-j) \end{aligned}$$

For the input of the sample $S(i_m)$ of the time which exceeds the time $t_l$ of the impulse response of the filter, the filter output $u'(i_m)$ is given by:

$$u'(i_m) = \sum_{j=0}^{t_l} h(j)\cdot S(i_m-j)$$

As is obvious from the foregoing, the crosscorrelation coefficient can not be acquired by forwardly (in the sampling sequence order of the input speech) supplying the waveform sample to the filter. In the conventional system, there is no alternative but to determine the sum of products by using a multiplier and an adder.

According to the present invention, the arithmetic operation quantity (time) needed for determining one crosscorrelation coefficient, as described above, does not depend on the duration time of the impulse response, but is simply equal to the arithmetic operation quantity of the filter itself. To be specific, 12 multiplications suffice in this embodiment.

Thus the sum of products of the speech waveform samples and the impulse response samples at each sample point can be obtained by backwardly applying the speech waveform samples to the filter. The obtained sum of products of the speech waveform and the impulse response obviously corresponds to the crosscorrelation coefficient therebetween. The search of the multi-pulse is carried out by taking advantages of such crosscorrelation coefficient determination.

Figure 4:
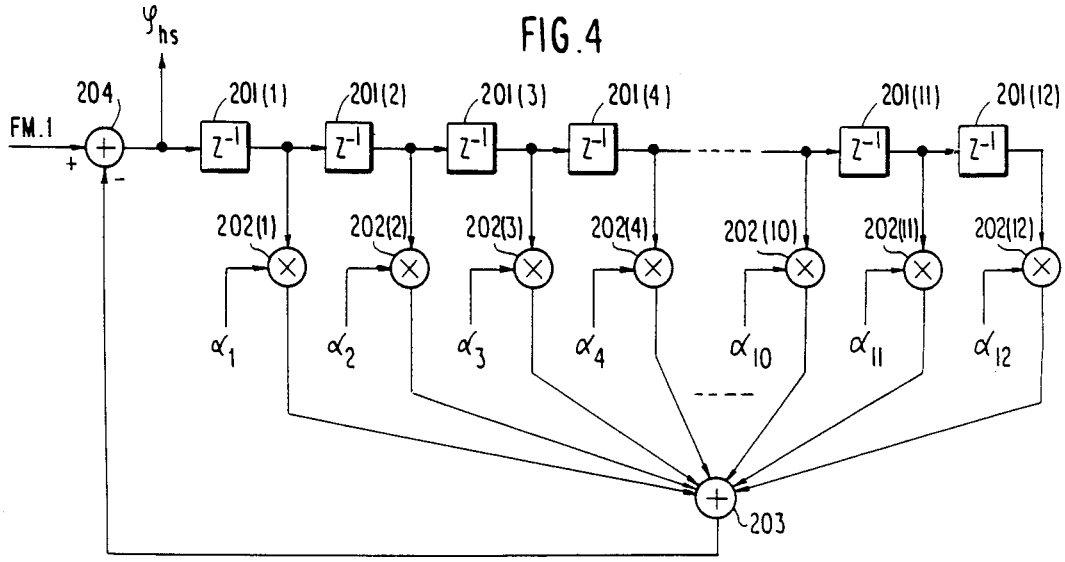
FIG. 4 is a block diagram of a filter used for obtaining the crosscorrelation coefficient according to the present invention.

FIG. 4 shows one construction example of the filter 2. The waveform sample data which are backwardly (in the reverse order to the speech sampling order) read out from the memory 1 are supplied to a (+) terminal of an adder 204. The adder 204 substracts the data supplied to a (−) terminal from the waveform data; and its output is inputted to a first stage delay element 201(1) among twelve pieces of unit delay elements 201(1) to 201(12) which are connected in series. The output of each individual unit delay element is multiplied by each of $\alpha$ parameters $\alpha_1$ to $\alpha_{12}$ which are supplied from a $K/\alpha$ converter 6 by means of multipliers 202(1) to 202(12) provided corresponding to the respective outputs. All the multiplying outputs of the multipliers 202(1) to 202(12) are added by the adder 203, and the added result is inputted to the (−) terminal of the adder 204. The crosscorrelation coefficient $\phi_{hs}$ is thus obtained as the output of the adder 204. That is, the filter 2 determines one crosscorrelation coefficient every time the speech waveform sample is inputted from the memory 1. The number of multiplications required for determining one crosscorrelation coefficient by the filter 2 is determined by the degree of the LPC coefficient ($\alpha$ parameter); and 12 multiplications are sufficient for this embodiment.

On the other hand, where the sum of products of the speech waveform and the impulse response waveform is determined in accordance with the computational formula (conventional technique), the sum of products between the waveforms is obtained by employing the sample data included in the impulse response length (duration). Supposing that the duration of the impulse response is 100 msec and a sampling frequency is 8 KHz, the number of multiplications necessary for determining one crosscorrelation coefficient is given such as: $100\times10^{-3}\times8\times10^{3}=800$. This value of arithmetic operation quantity is outstandingly greater than that of the present invention.

What is claimed is:

1. A multi-pulse coding system comprising:

memory means for storing a digital speech signal sampled at a predetermined sampling interval;

analysis means for developing an LPC (linear predictive coefficient) coefficient by analyzing said speech signal;

a recursive filter having a coefficient specified by said LPC coefficient;

supply means for backwardly supplying the speech signal read out from said memory means in the reverse order to the sampling order of said speech signal to said recursive filter to produce crosscorrelation coefficients between said speech signal and an impulse response of said recursive filter; and multi-pulse determining means for determining a predetermined number of multi-pulses on the basis of said produced crosscorrelation coefficients.

2. A multi-pulse coding system according to claim 1, further comprising means for quantizing said LPC coefficient ontained by said analysis means and decoding the quantized LPC coefficient, and interpolating means for interpolating the decoded LPC coefficient.

3. A multi-pulse coding system according to claim 2, wherein said LPC coefficient is an autocorrelation coefficient (K parameter), and said interpolated K parameter is converted into an $\alpha$ parameter.

4. A multi-pulse coding system according to claim 1, further comprising quantizing means for quantizing the multi-pulse and the LPC coefficient obtained by said multi-pulse searching means and said analysis means, and a multipliexer means for multiplexing the quantized multi-pulse and the LPC coefficient.

5. A multi-pulse coding system according to claim 4, further comprising a demultiplexer means for demultiplexing the multiplexed signals, means for separating the multi-pulse and the LPC coffficient from the demultiplexed signals and decoding the multi-pulse and the LPC coefficient, and a synthesis filter means for generating a synthesized speech with the decoded multi-pulse as an exciting source input and the LPC coefficient as a coefficient.

6. A multi-pulse coding system according to claim 1, wherein said supply means backwardly reads out said speech signal from said memory means.

7. A multi-pulse coding system according to claim 1, wherein said recursive filter includes: first adding means, whose (+) input terminal receives the signal supplied from said supply means, for generating the added signal as an output of said recursive filter; a plurality of unit delay means connected in series for receiving the output of said first adding means each of said unit delay means having a time delay with a sampling interval and the number of said unit delay means being equal to the order of the LPC coefficient; a plurality of multiplying means each connected to the corresponding output of said unit delay means for multiplying said corresponding output with said LPC coefficient sent from said analysis means; and second adding means for adding the outputs of said multiplying means and supplying the added signal to a (−) input terminal of said first adding means.

8. A multi-pulse coding system comprising:

means for inputting a digital speech signal sampled at a predetermined sampling interval to a memory means;

analysis means for developing an LPC (linear predictive coefficient) coefficient by analyzing said speech signal;

a recursive filter having a coefficient specified by said LPC coefficient;

supply means for backwardly reading out the speech signal from said memory means in the reverse order to the inputting order of said speech signal to said memory means and supplying the read out signal to said recursive filter to produce crosscorrelation coefficients between said speech signal and an impulse response of said recursive filter; and multi-pulse determining means for determining a predetermined number of multi-pulses on the basis of said produced crosscorrelation coefficients.

9. A multi-pulse coding method comprising the steps of:

developing an LPC (Linear Predictive Coefficient) coefficient specifying the coefficient of a recursive filter from a digital speech signal sampled at a predetermined interval;

backwardly supplying said speech signal in the reverse order to the sampling order of said speech signal to the recursive filter to produce crosscorrelation coefficients between said speech signal and an impulse response of said recursive filter; and determining a predetermined number of multi-pulses on the basis of said produced crosscorrelation coefficients.

* * * * *

UNITED STATES PATENT AND TRADEMARK OFFICE

CERTIFICATE OF CORRECTION

PATENT NO. : 4,908,863

DATED : March 13, 1990

INVENTOR(S) : Tetsu TAGUCHI

It is certified that error appears in the above-identified patent and that said Letters Patent is hereby corrected as shown below:

Col. 2, lines 43 and 44, delete "there performs enlarging and levelling the bandwidth";

Col. 2, line 59, delete "yi" and insert --$y^i$--;

Col. 2, line 60, delete "a = 0.8" and insert --y = 0.8--.

Col. 6, line 3, delete "synshteis" and insert --synthesis--;

Col. 6, line 24, delete "ignore" and insert --ignored--.

Col. 7, line 38, after "h(0)" insert -- = --.

Signed and Sealed this

Twenty-seventh Day of August, 1991

*Attest:*

HARRY F. MANBECK, JR.

*Attesting Officer*

*Commissioner of Patents and Trademarks*